United States Patent [19]

Winterbottom

[11] 4,095,294

[45] Jun. 20, 1978

[54] SOFT PUNCH

[76] Inventor: Harold E. Winterbottom, 1702 Lansing Rd., Glen Burnie, Md. 21061

[21] Appl. No.: 755,005

[22] Filed: Mar. 21, 1977

[51] Int. Cl.[2] ..... A41D 13/10; A63B 71/10

[52] U.S. Cl. ..... 2/424; 2/413; 2/18

[58] Field of Search ..... 2/413, 18, 161 A, 424, 2/9, 421

[56] References Cited

U.S. PATENT DOCUMENTS

| | | | |
|---|---|---|---|
| 2,135,853 | 11/1938 | Slizus et al. | 2/18 |
| 2,664,567 | 1/1954 | Nichols | 2/9 X |
| 2,817,088 | 12/1957 | Vrana | 2/18 |
| 2,826,757 | 3/1958 | Vrana | 2/18 |
| 3,166,761 | 1/1965 | Strohm | 2/421 |
| 3,186,004 | 6/1965 | Carlini | 2/413 |
| 3,220,014 | 11/1965 | Strohm et al. | 2/9 |
| 3,513,482 | 5/1970 | Holden | 2/421 |
| 3,527,461 | 9/1970 | Prater | 2/424 |
| 3,934,271 | 1/1976 | Rhee | 2/424 |
| 4,014,048 | 3/1977 | Rappleyea | 2/413 |

FOREIGN PATENT DOCUMENTS

| | | | |
|---|---|---|---|
| 739,377 | 10/1932 | France | 2/18 |
| 568,033 | 10/1975 | Switzerland | 2/413 |
| 925,669 | 5/1963 | United Kingdom | 2/18 |
| 397,212 | 1/1974 | U.S.S.R. | 2/18 |

*Primary Examiner*—Werner H. Schroeder
*Assistant Examiner*—Moshe I. Cohen
*Attorney, Agent, or Firm*—John F. McClellan, Sr.

[57] ABSTRACT

A system for preventing boxers from becoming discouraged by the force of blows received before they develop boxing technique to minimize the impact of blows, includes inflatable head gear with openings matched in proportion to the size of inflatable gloves, both headgear and gloves having additional safety featues to prevent accidental injury.

1 Claim, 4 Drawing Figures

SOFT PUNCH

This invention relates generally to athletic equipment and specifically to boxing gear.

Both boxing gloves and protective headgear are known in prior art, but conventional equipment of this type has been found deficient for early training or initial training purposes. Boxers wearing conventional gloves can inflict blows that unduly shock beginners before they learn to roll with the punch. Conventional headgear helps some, but being relatively hard and heavy, with large openings, permits the head to be unnecessarily wrenched and battered by the force of blows.

Accordingly, principal objects of the present invention are to provide a soft-punch boxing glove/boxing headgear system which permits the user to move more freely than with heavy equipment but which at the same time lessens shock and injury during training.

In brief summary given for purposes of cursive description only and not as limitation the invention includes provision of matched sets of inflatable gloves and inflatable headgear for boxing training.

The above and other objects and advantages of this invention will become more readily apparent on examination of the following description, including the drawings in which like reference numerals refer to like parts.

Figure 1:
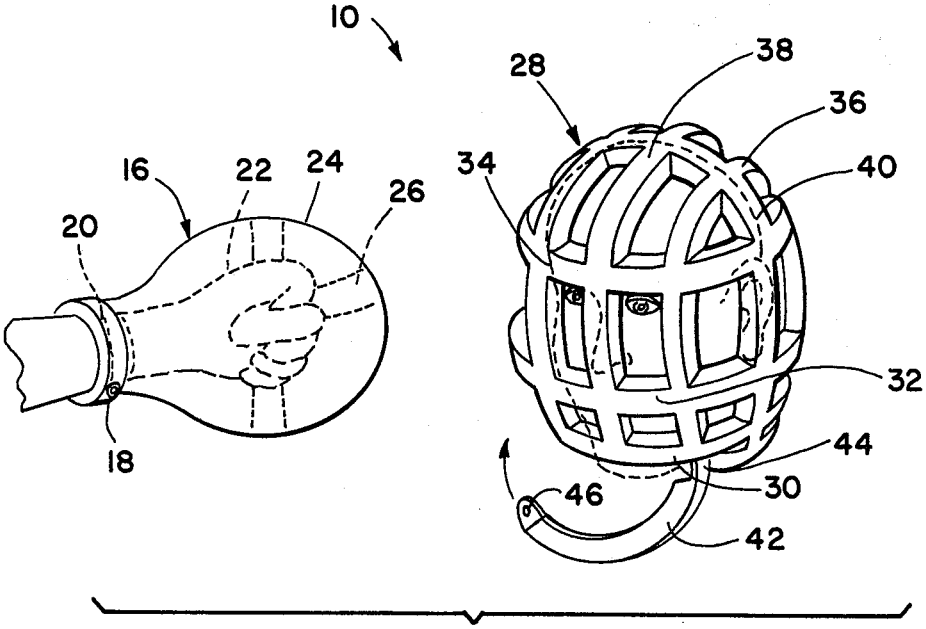
FIG. 1 is a perspective view of matched inflatable boxing glove and inflatable headgear according to this invention.

FIG. 1 shows the invention 10 embodied in a pneumatic boxing glove 16 having an inflation air-filling fitting 18 safely located at the cuff and internal elastic 20 to help hold the glove on the user's wrist if desired. The forward or striking portion of the glove is spherical and larger than conventional gloves. The inner wall 22 is designed to afford a pneumatic cushion which may advantageously to 3 or 4 inches thick between the knuckles of the user and the outer wall 24.

Diameter of the spherical portion is such as to prevent it from passing through the vents of the special headgear provided as part of this invention. The full double-wall prevents injury from side-of-hand and wrist impacts, and snugly fits the glove to the hand. Internal gussets 26 may be used to insure that the hand remains centered by connecting the walls. The special headgear 28 has inflatable ribs in a spherical configuration preferably in the form of a series of life-ring type bladders for encircling the head horizontally, at the chin position as at 30, and intersecting these a series of bladders one of which may encircle each respective side of the head as at 36, a horseshoe-shaped one of which may encircle the head from chin up over the nose and down the neck behind as at 38, and a second horseshoe shaped one of which may pass from the base of the jaw position on one side up over the ear position and crown and similarly down the other side as at 40.

A chin strap 42 which may advantageously be a thick polyurethane foam bar-shaped cushion or the like has a strap hinge 44 at one end and a snap fastening 46 at the other.

As noted, the device when inflated presents a bar spacing or venting for vision, hearing, breathing and cooling through which the glove will not reach; the thickness of the bars may be two inches and the width similar, desirably cushioning blows to the head. The arcuate configuration prevents snagging and tightens comfortably.

Figure 2:
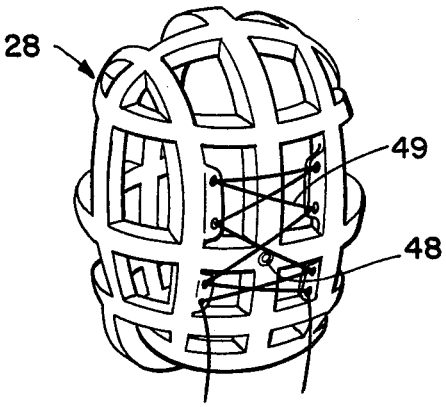
FIG. 2 is a rear perspective view of the inflatable headgear.

FIG. 2 shows the rear view. Even though inflating the head gear as by the football type valve 48 safely in the center at the rear will tend to hold it in place, together with fastening the chin strap, gusset attached laces 49 across the side bladders can be used to adjust and tighten it further as desired. It can be seen that the rear of the head is protected against rabbit-punches and against falls to the side and backward, in similar manner to protection at the front of the head.

Figure 3:
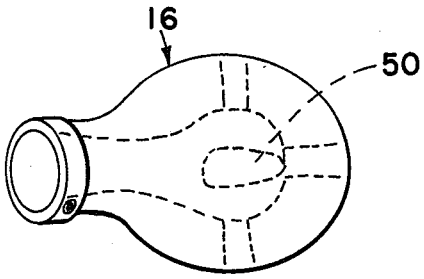
FIG. 3 is a perspective view of the inflatable boxing glove.

FIG. 3 emphasizes a further safety feature, a thumb pocket 50 provided inside the glove, helping secure the glove on the hand and preventing accidental injury to the thumb and to the eyes of opponents.

Figure 4:
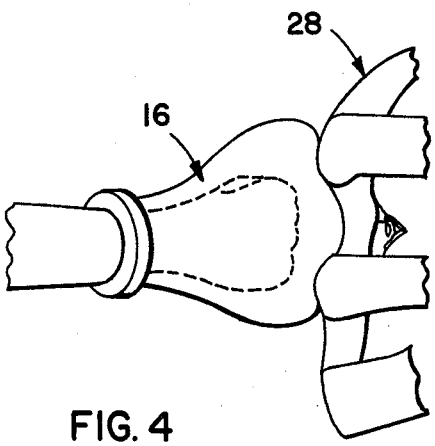
FIG. 4 is a fragmentary side elevational view of the inflatable glove striking the inflatable headgear.

FIG. 4 illustrates the double-cushioning effect of the glove 16 and headgear 28 on impact, each unit yielding on every punch. In yielding the glove elastically grows wider and the ribs of the headgear elastically widen futher constricting the vents in the headgear material for the gloves and the headgear may be the same, a good grade of rubber such as that used for inner tubes, which may be 1/32 inch thick. Smoothness of the rubber helps prevent abrasive injury to the torso.

In conclusion it can be seen that the invention provides safety, comfort and convenience in a size adaptable system combining durability and economy, useful in encouraging beginners to learn the elements of boxing.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A punch softening system for boxing comprising: a proportionally and structurally matched set consisting of: a pair of inflatable boxing gloves and inflatable headgear having rib structure including a series of interconnected arcuate members defining vents therein, each inflatable boxing glove when inflated being larger than said vents and all said inflatable boxing gloves and inflatable headgear being of elastic material such as rubber causing elastic widening of all said inflatable boxing gloves and ribs on impact therebetween for preventing passage of a portion of an inflatable boxing glove through a vent during boxing, each inflatable boxing glove having a full double wall throughout including an inflatable cuff, each inflatable cuff having an inflation valve therein and each inflatable boxing glove having an internal thumb pocket therein; the inflatable headgear having means for tightening including inflation means at the rear thereof, and a foam cushion chin strap.

* * * * *